United States Patent [19]

Coffman

[11] Patent Number: 4,926,568

[45] Date of Patent: May 22, 1990

[54] SOLE PROTECTOR ATTACHMENT

[76] Inventor: Cynthia L. Coffman, 909 Madeira N.E., Albuquerque, N. Mex. 87108

[21] Appl. No.: 306,628

[22] Filed: Feb. 6, 1989

[51] Int. Cl.[5] ..... A43B 13/28; A43B 3/24; A61F 5/14

[52] U.S. Cl. ..... 36/15; 36/9 R; 36/101; 128/582

[58] Field of Search ..... 36/9 R, 11.5, 15, 101, 36/72 R; 2/239, 241, DIG. 6; 128/582

[56] References Cited

U.S. PATENT DOCUMENTS

| | | | |
|---|---|---|---|
| 1,328,665 | 1/1920 | Gillenwaters | 36/25 R |
| 1,360,995 | 12/1920 | Anderson | 36/73 |
| 2,108,658 | 2/1938 | Dunbar | 36/7.3 |
| 2,475,859 | 7/1949 | Stroh | 36/70 |
| 2,495,984 | 1/1950 | Roy | 36/9 R |
| 2,552,096 | 5/1951 | Johnson | 36/70 |
| 2,734,268 | 2/1956 | Anbon | 128/582 |
| 2,746,173 | 5/1956 | Tranmal | 36/58.5 |
| 2,965,982 | 12/1960 | Saffir | 36/58.5 |
| 3,059,350 | 10/1962 | Price | 36/106 |
| 3,099,884 | 8/1963 | Kixmiller et al. | 36/101 |
| 3,538,628 | 11/1970 | Einstein, Jr. | 36/15 |
| 3,595,244 | 7/1971 | Kugler | 36/11.5 |
| 4,317,292 | 3/1982 | Melton | 36/9 R |
| 4,782,603 | 11/1988 | Brown | 36/29 |
| 4,802,463 | 2/1989 | Rojas | 128/582 |
| 4,823,799 | 8/1989 | Robbins | 128/582 |

*Primary Examiner*—Steven N. Meyers
*Attorney, Agent, or Firm*—Jerry T. Kearns

[57] ABSTRACT

A sole protector attachment for securement to the bottom portion of woven or knitted socks or slippers includes a sole-shaped thin flat pad formed from a wear resistant material such as vinyl or leather. A narrow edging extends around a periphery of the pad and has an upper surface provided with hook fastener portions of cooperating hook and loop type fastening strips. The hook fasteners engage in the intersticial portions of the fabric of the woven or knitted sock or slipper and serve to secure the sole protector to the bottom surface thereof. In a second embodiment, a plurality of transversely extending elongated rods are sandwiched between the pad and an outer sole member for providing a massaging effect to a wearer.

6 Claims, 5 Drawing Sheets

SOLE PROTECTOR ATTACHMENT

BACKGROUND OF THE INVENTION

1. Field of the Invention

The present invention relates to sole protector attachments, and more particularly pertains to a new and improved sole protector attachment particularly designed for use with woven or knitted socks or slippers. Many individuals enjoy wearing the knitted type of slippers. These slippers are extremely warm and comfortable and are often made by hand by friends or relatives and thus have sentimental value for a wearer. These knitted types of socks or slippers have a substantial disadvantage because they are subject to rapid wear of the bottom sole portion. The present invention seeks to overcome this problem by providing a sole protector attachment in the form of a thin flat pad to prevent wear of the sole portion. The sole protector attachment is constructed so as to be readily removable to allow washing of the woven or knitted sock or slipper. Compact, portable, ideal for children of all ages. Convenient to use at or away from home.

2. Description of the Prior Art

Various types of sole protector attachments are known in the prior art. A typical example of such a sole protector attachment is to be found in U.S. Pat. No. 1,328,665, which issued to J. Gillenwaters on Jan. 20, 1920. This patent discloses a shoe having an upper fabric portion and an attached sole formed from a continuous coil strip formed from a braided fibrous material. U.S. Pat. No. 1,360,995, which issued to F. Anderson on Dec. 7, 1920, discloses an attachment for shoes to provide an enhanced walking motion. A fastening strap is utilized to secure the device to the sole of a shoe. U.S. Pat. No. 2,108,658, which issued to E. Dunbar on Feb. 15, 1938, discloses a rubber overshoe having a rubber covered hardened metal heel plate having hardened metal anchoring tongues to enhance securement of the heel plate to the overshoe. U.S. Pat. No. 2,475,859, which issued to H. Stroh on July 12, 1949, discloses an attachment for the heel of a shoe which includes a resilient corner splash guard. U.S. Pat. No. 2,552,096, which issued to J. Johnson on May 8, 1951, discloses a sheath for securement over an elongated heel of a woman's shoe. A strap is utilized to secure the sheath in position.

While the above mentioned devices are suited for their intended usage, none of these devices disclose a sole protector suitable for use with woven or knitted socks or slippers. The previously described devices illustrate a variety of conventional attachment mechanisms for securing overshoes and other attachments to the soles of conventional shoes. These conventional securing arrangements are not suitable for use with woven socks or slippers because they are bulky and cumbersome and would greatly detract from the comfort of the wearer. The present invention overcomes these problems by utilizing an extremely thin narrow edging bearing hook fastening portions of a conventional hook and loop type fastening strip. This construction is not disclosed in the aforementioned patents. Inasmuch as the art is relatively crowded with respect to these various types of sole protector attachments, it can be appreciated that there is a continuing need for and interest in improvements to such sole protector attachments, and in this respect, the present invention addresses this need and interest.

SUMMARY OF THE INVENTION

In view of the foregoing disadvantages inherent in the known types of sole protector attachments now present in the prior art, the present invention provides an improved sole protector attachment. As such, the general purpose of the present invention, which will be described subsequently in greater detail, is to provide a new and improved sole protector attachment which has all the advantages of the prior art sole protector attachments and none of the disadvantages.

To attain this, representative embodiments of the concepts of the present invention are illustrated in the drawings and make use of a sole protector attachment for securement to the bottom portion of woven or knitted socks or slippers including a sole-shaped thin flat pad formed from a wear resistant material such as vinyl or leather. A narrow edging extends around a periphery of the pad and has an upper surface provided with hook fastener portions of cooperating hook and loop type fastening strips. The hook fasteners engage in the interstitial portions of the fabric of the woven or knitted sock or slipper and serve to secure the sole protector to the bottom surface thereof. In a second embodiment, a plurality of transversely extending elongated rods are sandwiched between the pad and an outer sole member for providing a massaging effect to a wearer.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sole protector attachment which has all the advantages of the prior art sole protector attachments and none of the disadvantages.

It is another object of the present invention to provide a new and improved sole protector attachment which may be easily and efficiently manufactured and marketed.

It is a further object of the present invention to provide a new and improved sole protector attachment which is of a durable and reliable construction.

An even further object of the present invention is to provide a new and improved sole protector attachment which is susceptible of a low cost of manufacture with regard to both materials and labor, and which accordingly is then susceptible of low prices of sale to the consuming public, thereby making such sole protector attachments economically available to the buying public.

Still yet another object of the present invention is to provide a new and improved sole protector attachment which provides in the apparatuses and methods of the prior art some of the advantages thereof, while simultaneously overcoming some of the disadvantages normally associated therewith.

Still another object of the present invention is to provide a new and improved sole protector attachment for securement to the bottom portion of woven or knitted socks or slippers.

Yet another object of the present invention is to provide a new and improved sole protector attachment to protect the bottom portion of woven socks or slippers from wear and which is easily removable to allow washing. Compact and portable, convenient for use with children and while traveling.

Even still another object of the present invention is to provide a new and improved sole protector attachment which utilizes hook portions of conventional cooperating hook and loop type fastening strips for comfortably securing a wear resistant pad to the bottom portion of woven or knitted socks or slippers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
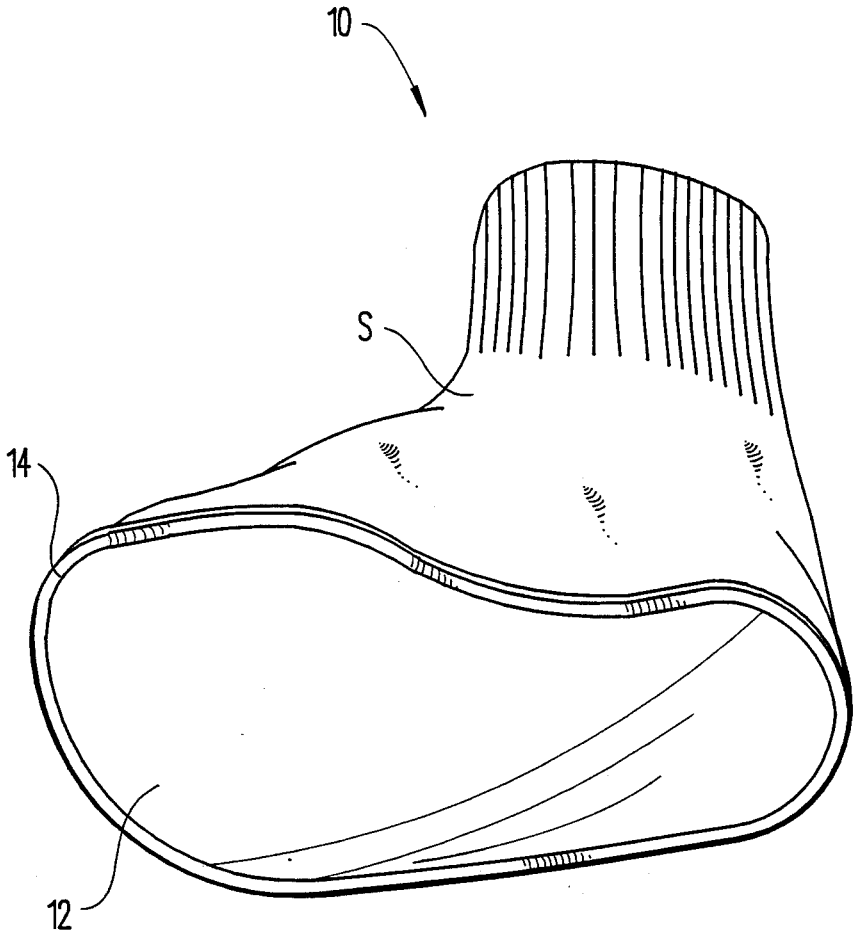
FIG. 1 is a perspective view illustrating the sole protector attachment according to a first embodiment of the present invention installed on a conventional woven or knitted slipper.

With reference now to the drawings, and in particular to FIG. 1 thereof, a new and improved sole protector attachment embodying the principles and concepts of the present invention and generally designated by the reference numeral 10 will be described.

More specifically, it will be noted that the first embodiment 10 of the invention includes a thin flat sole-shaped pad 12 preferably formed from a wear resistant material such as leather or vinyl. The illustrated bottom surface of the pad 12 may be textured to provide a non slip surface. A narrow edging 14 extends around a periphery of the pad 12. The pad 12 forms a sole protector attachment which is illustrated installed on a conventional woven or knitted slipper S. The pad 12 is preferably die cut to a shape slightly smaller than the bottom surface of the slipper S. The applied edging 14 is dimensioned to engage the periphery of the bottom portion of the slipper S. In use, the pad 12 prevents wear on the bottom portion or sole of the slipper S, and may be easily removed to allow washing of the slipper S. Compact, portable.

Figure 2:
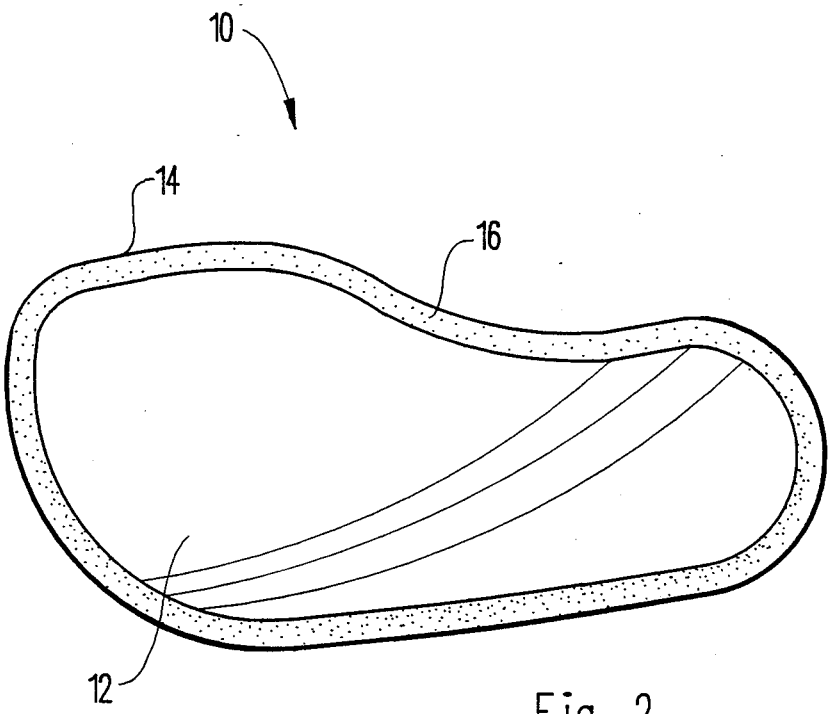
FIG. 2 illustrates a top view of the sole protector attachment according to the first embodiment of the present invention.

FIG. 2 illustrates a top view of the sole protector attachment 10, removed from the slipper S of FIG. 1. As illustrated, the peripheral edging 14 has an upper surface 16 which is provided with a plurality of closely spaced hook fasteners of a conventional cooperating hook and loop fastening strip. A suitable fastener is sold under the trademark VELCRO. The hook fastening portions 16 do not require the customary cooperating hook fastening portion but instead engage the interstitial portion of the woven or knitted slipper S. Thus, each hook fastener is received between adjacent fabric threads which function as the conventional cooperating loop fasteners. Thus, the attachment pad 12 is securely, but removably fastened on the bottom of the slipper S, as illustrated in FIG. 1. The advantage of utilizing this fastening mechanism is that it requires no belts, buckles, snaps or straps and is thus extremely thin and comfortable for the wearer. It is an important feature of the invention that the hook type fasteners 16 are provided only on a narrow peripheral edging because this allows easy removability without damage to the slipper, and maximizes the comfort of the wearer.

Figure 3:
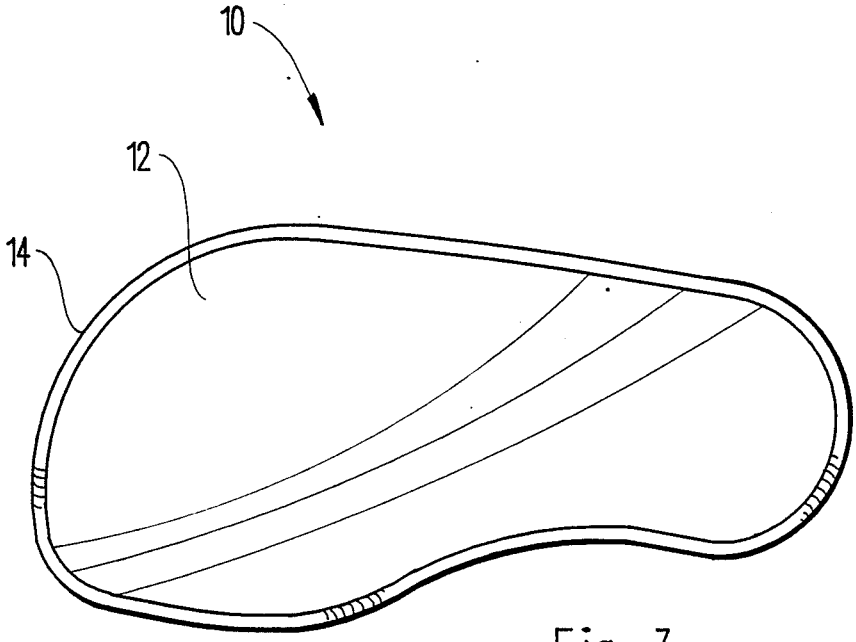
FIG. 3 illustrates a bottom view of the sole protector attachment according to the first embodiment of the present invention.

FIG. 3 provides a bottom view of the sole protector attachment 10. The pad 12, as previously mentioned, is preferably formed from a wear resistant material such as leather or vinyl, and may be provided with a variety of conventional traction enhancing patterns.

Figure 4:
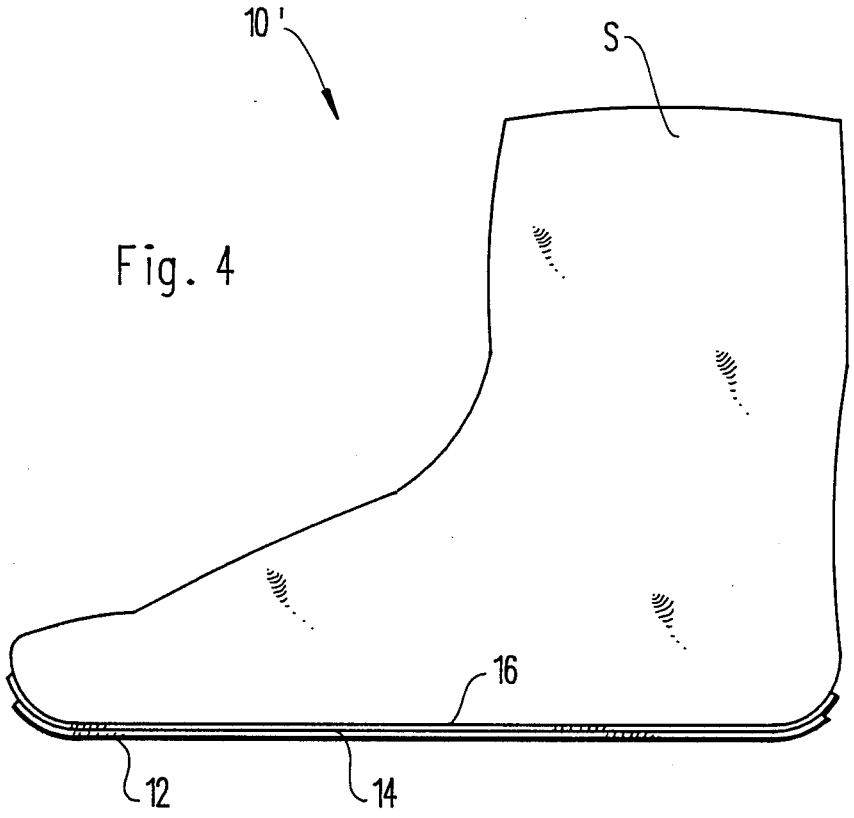
FIG. 4 illustrates a side view of a slightly modified sole protector attachment according to a second embodiment of the present invention installed on a conventional woven or knitted sock.

FIG. 4 illustrates a slightly modified second embodiment 10′ of the present invention. The second embodiment 10′ is particularly designed for use with woven or knitted socks S, thus converting these conventional socks into a form of slipper. The pad 12 is similarly formed with reference to the first embodiment of the invention except is generally of a thinner material to allow a greater degree of flexibility. This allows the pad 12 to more readily conform to the bottom portion of the sock S and provides enhanced securement thereto. May be cut slightly larger, conforming and securing 1/2 inch up the side of the foot for extra protection.

Figure 5:
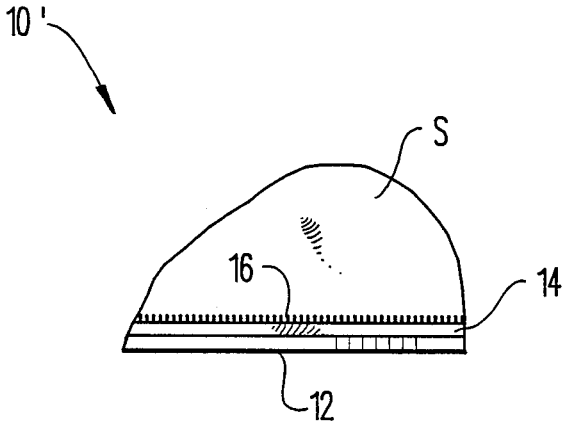
FIG. 5 provides an enlarged partial detail view illustrating the securement of the sole protector attachment on the conventional sock.

FIG. 5 illustrates enlarged partial detail view which illustrates the hook fastening portions 16 engaged with the fabric on the bottom surface of the woven or knitted sock S.

Figure 6:
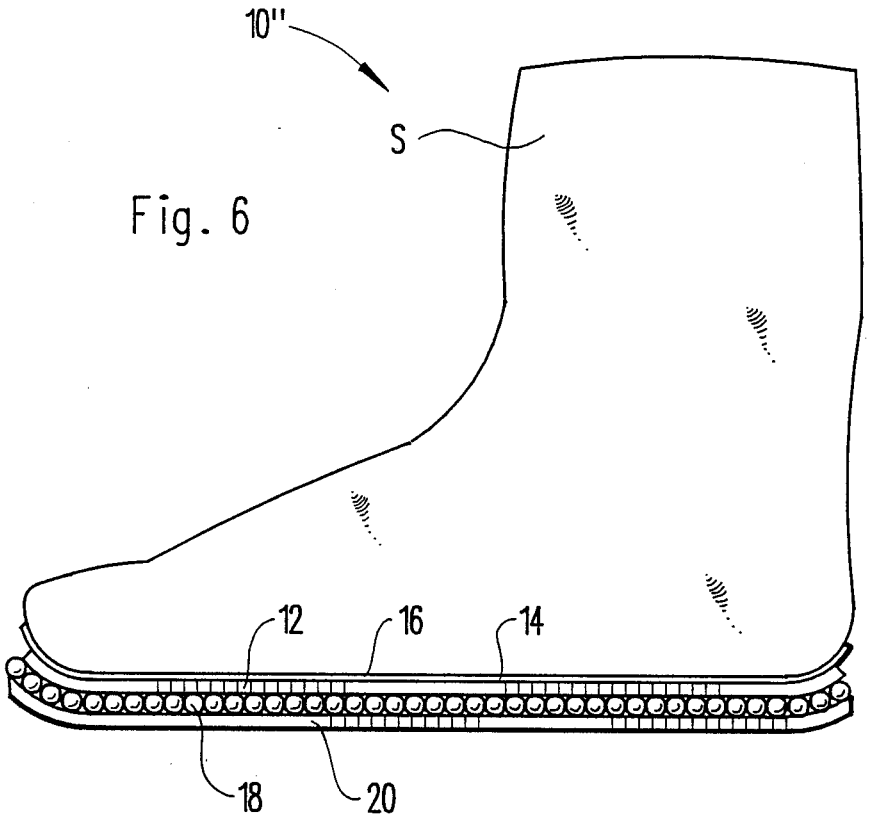
FIG. 6 is a side view illustrating a sole protector attachment according to a third embodiment of the present invention which includes foot massage elements.

FIG. 6 illustrates a third embodiment 10″ of the invention which includes a plurality of transversely extending cylindrical rods 18 sandwiched between the pad 12 and a secondary pad or sole member 20. The rod 18 serves as massage elements which exercise and massage the feet of a wearer. The massage elements 18 may be provided in sole protector attachments configured for use with the illustrated sock S or the previously illustrated slipper. The rod 18 preferably comprise slightly resilient hard rubber rods but may be formed as small diameter wooden or plastic rods. The rods 18 are sandwiched between the sole member 20 and pad 12 and may be secured through stitching or adhesive bonding. The sole 12 is provided with the previously described peripheral edging 14 and hook type fastener 16 which engage the fabric material on the bottom surface of the sock S.

Figure 7:
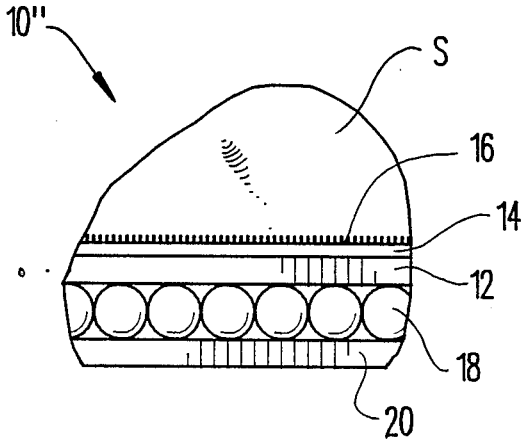
FIG. 7 illustrates a partial enlarged detail view illustrating the constructional features of the sole protector attachment of FIG. 6.

FIG. 7 provides a partial enlarged detail view which illustrates the hook fastener 16 secured to the sock S. The massage elements 18 are illustrated sandwiched between the pad 12 and sole member 20.

Figure 8:
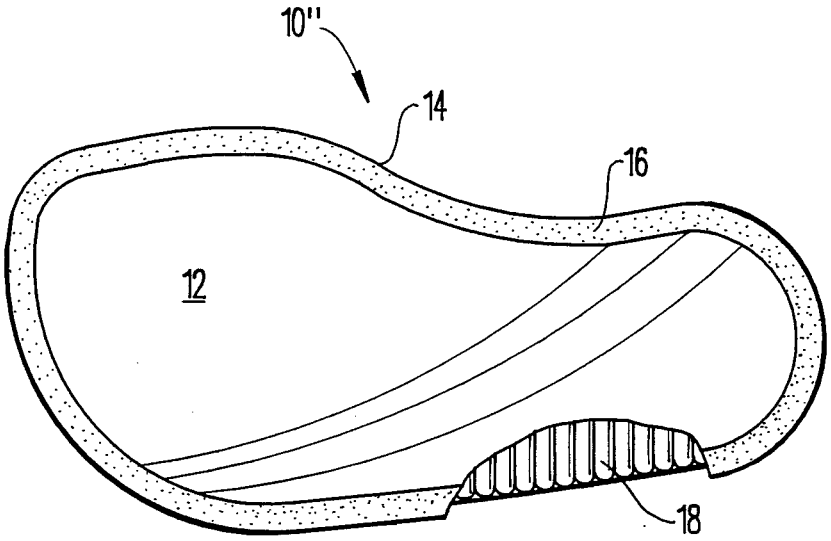
FIG. 8 is a top view, partially cut away, illustrating the sole protector attachment of FIG. 6.

FIG. 8 illustrates a top view which is partially cut away, to illustrate the massage rod elements 18.

Figure 9:
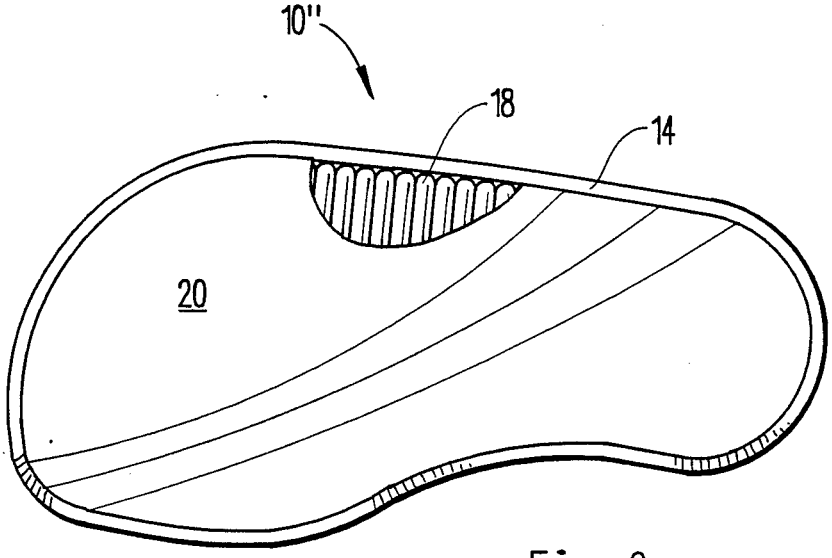
FIG. 9 is a bottom view, partially cut away, illustrating the sole protector pad of FIG. 6.

FIG. 9 provides a bottom view of the sole protector attachment 10″, with the sole member 20 partially cut away to again illustrate the massage rod elements 18.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sole protector attachment for securement to a woven or knitted sock or slipper, comprising:
   - a sole-shaped thin flat flexible pad formed from a wear resistant material;
   - a narrow edging extending only around a periphery of said pad;
   - said edging having an upper surface provided with hook portions of cooperating hook and loop type fastening strips for engagement with said woven or knitted sock or slipper;
   - a sole member extending in spaced parallel relation with said pad; and
   - a plurality of elongated transversely extending unconnected solid rods sandwiched between said pad and said sole member, said rods disposed in side by side abutting relation and extending along the entire length of said sole member.

2. The sole protector attachment of claim 1, wherein said pad is formed from leather.

3. The sole protector attachment of claim 1, wherein said pad is formed from vinyl.

4. In combination with a woven or knitted sock or slipper, the improvement comprising a sole protector attachment including:
   - a sole-shaped thin flat flexible pad formed from a wear resistant material;
   - a narrow edging extending only around a periphery of said pad;
   - said edging having an upper surface provided with hook portions of cooperating hook and loop type fastening strips in engagement with said woven or knitted sock or slipper and removably securing said sole protector attachment to a bottom portion of said sock or slipper;
   - a sole member extending in spaced parallel relation with said pad; and
   - a plurality of elongated transversely extending unconnected solid rods sandwiched between said pad and said sole member, said rods disposed in side by side abutting relation and extending along the entire length of said sole member.

5. The sole protector attachment of claim 4, wherein said pad is formed from leather.

6. The sole protector attachment of claim 4, wherein said pad is formed from vinyl.

* * * * *